US005706949A

United States Patent [19]

Amato

[11] Patent Number: 5,706,949

[45] Date of Patent: Jan. 13, 1998

[54] PARTY KIT FOR SERVING GUESTS (PARTY IN A BOX)

[76] Inventor: Christine Amato, 70 Calvert Ave., East, Edison, N.J. 08820

[21] Appl. No.: 607,275

[22] Filed: Feb. 21, 1996

[51] Int. Cl.[6] ..... B65D 1/34

[52] U.S. Cl. ..... 206/553; 206/542; D6/617

[58] Field of Search ..... 206/390, 542, 206/546, 548, 553, 223; 220/908, 910; 229/108.1, 108, 901, 907; 248/907; D6/617, 623

[56] References Cited

U.S. PATENT DOCUMENTS

| | | | |
|---|---|---|---|
| D. 318,971 | 8/1991 | Mitchell | D6/617 |
| 2,728,165 | 12/1955 | Runyon | D6/617 |
| 3,097,782 | 7/1963 | Koropatkin et al. | 206/542 |
| 3,368,601 | 2/1968 | Gantert-Merz | D6/617 |
| 3,926,362 | 12/1975 | Beck et al. | 229/901 |
| 3,939,976 | 2/1976 | Van Iseghem, Jr. | 206/390 |
| 4,337,812 | 7/1982 | Trinkner | D6/617 |
| 4,721,140 | 1/1988 | Coker | D6/617 |
| 4,750,402 | 6/1988 | Markey | D6/617 |
| 4,827,107 | 5/1989 | Peery | D6/617 |
| 5,260,536 | 11/1993 | Peery | D6/617 |
| 5,314,232 | 5/1994 | Hopkins | 206/553 |

*Primary Examiner*—David T. Fidei
*Attorney, Agent, or Firm*—Plevy & Associates

[57] ABSTRACT

A serving platform for holding and dispensing tableware and utensils at a party or other such function. A covering made from cloth or other suitable material is disposed over a container. The container is preferably a knock-down box. The covering has a plurality of pockets attached thereto for dispensing utensils such as knives, forks or spoons or for dispensing napkins or other tableware. The pockets are disposed along the sides of the container and may be divided into subpockets. The covering may be fitted around the bottom surface of the container.

19 Claims, 4 Drawing Sheets

PARTY KIT FOR SERVING GUESTS (PARTY IN A BOX)

FIELD OF THE INVENTION

The present invention relates generally to tableware kits and more specifically to a tableware kit which includes a knock-down container that assembles into a tableware serving platform.

BACKGROUND OF THE INVENTION

Parties are a popular way to gather with friends and relatives, to escape from the rigors of everyday life and relax. People throw parties to celebrate religious and secular holidays, birthdays, anniversaries, weddings, bar and bat mitzvahs, the Super Bowl and many other occasions. Parties are usually accompanied by a cornucopia of food and drink. It would be desirable to provide an attractive serving platform so that the tableware is readily accessible to the party goers. It would also be desirable if the serving platform could be transported disassembled to the site of the party, or alternatively assembled and used as a carrier for transporting the tableware and utensils to and from the party.

The prior art has provided various devices that operate as serving platforms at parties and other functions. U.S. Pat. No. 2,604,373 entitled CONVERTIBLE TABLE AND BAR issued to Beriou, et al. on Jul. 22, 1952 is exemplary. This device is a foldable piece of furniture. When open, the device serves as a table and bar. When folded, the device provides storage for liquor bottles and the like. The disadvantage of this device is that is does not provide easy access to party utensils and tableware and furthermore it is a fairly large, unattractive and clumsy device.

The prior art has also provided many devices designed for carrying tableware to remote locations. The common picnic basket is a well known example. A disadvantage of the common picnic basket is that it is relatively unattractive and would look out of place at a party celebrating a wedding anniversary or other such function. Another disadvantage of a picnic basket is that it does not double as a serving platform nor can it be brought to the party disassembled.

Several prior art patents have attempted to overcome the disadvantages of the common picnic basket. For example, U.S. Pat. No. 4,499,999 entitled PICNIC BASKET issued on Feb. 19, 1985 to Behar discloses an apparatus formed from cloth material which can serve as a picnic basket and double as a tablecloth. This device suffers from several disadvantages. First, it is a relatively complicated device and therefore relatively difficult and expensive to manufacture. The cloth member comprises nine separate panels which are folded and connected into the desired configuration. A separate handle member is then affixed. Furthermore, this device does not provide a serving platform upon which tableware can be placed.

Another prior art device is disclosed in U.S Pat. No. 5,110,193 entitled PORTABLE TRAVEL PANTRY issued on May 5, 1992 to McClenning. This patent discloses a box-like structure having compartments for storing utensils and having external handle means. A disadvantage of this device is that it does not provide an external means for storing utensils so the utensils are not readily accessible.

Yet another prior art device is disclosed in U.S. Pat. No. 4,337,812 entitled COMBINED PICNIC BAG AND TABLECLOTH issued on Jul. 6, 1982 to Trinkner. This device is a circular cloth cover having a draw string around its peripheral edge. A pocket is attached to the center of the cloth cover. The cover can serve as a tablecloth. When the draw string is pulled taut, the cover takes the shape of a bag. This device suffers from the disadvantage of not providing a serving platform.

It is therefore an object of the present invention to provide an improved serving platform for holding and dispensing tableware and utensils which can substantially overcome the problems of the prior art.

SUMMARY OF THE INVENTION

The present invention is an attractive serving platform for holding and dispensing tableware and utensils at a party or other such function. A knock-down container is provided that is assembled at the site of the party. A flexible cover is formed from cloth material and has a number of pockets for retaining utensils and tableware sewn to one surface. The flexible cover is draped over the container so that it covers the top surface and the sides of the container. The pockets are located on the portion of the cover that is draped over the sides of the container. One or more of the pockets are divided into subpockets for holding forks, knives, etc. The cover is attached to the bottom of the container thereby forming an attractive serving platform. In the preferred embodiment, the serving platform presents a flat top surface upon which plates or tableware may be positioned. In a second embodiment, a slot-shaped aperture is cut into the top surface of the container and into the corresponding portion of the cover. In this embodiment, plates can be placed into the aperture so that the plates are displayed in a substantially vertical orientation.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
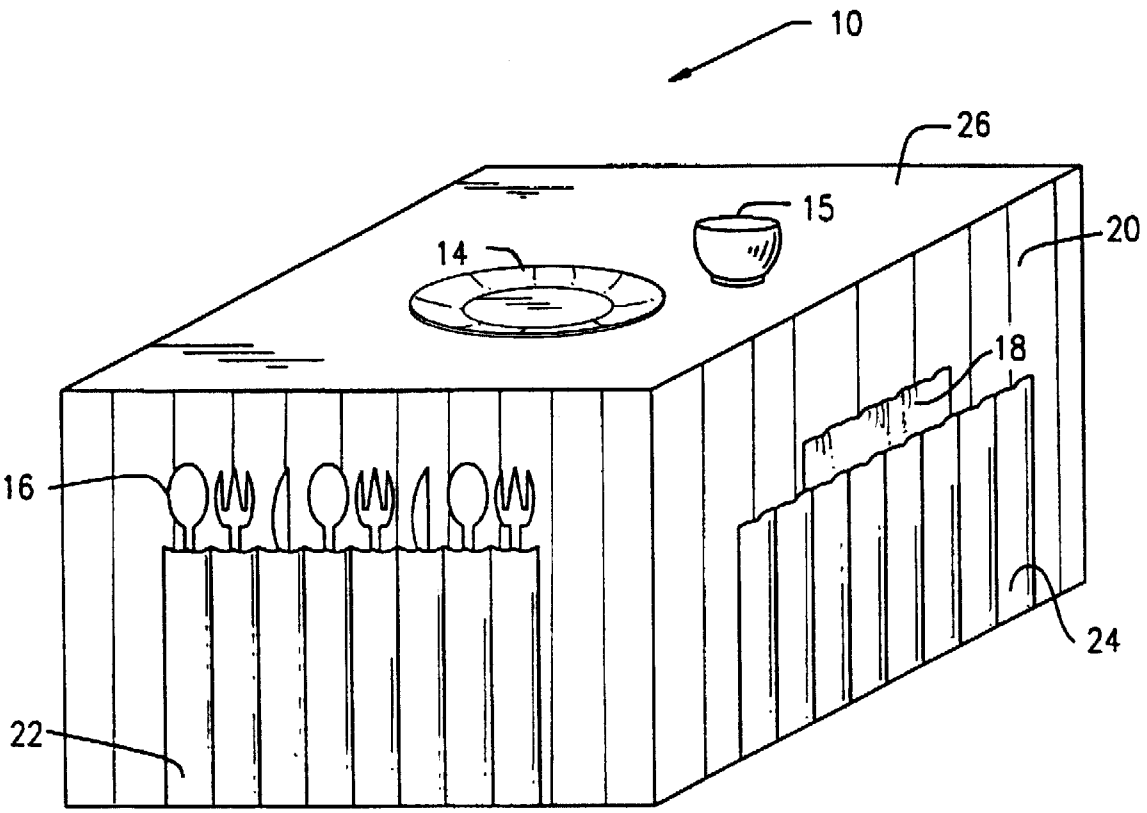
FIG. 1 is a perspective front view of the preferred embodiment of the serving platform of the present invention.

Referring to FIG. 1, the preferred embodiment of the serving platform 10 of the present invention is depicted. The serving platform 10 is particularly well suited for dispensing various tableware items such as disposable plates 14, bowls, cups 15, eating utensils 16, napkins 18, etc. at parties, picnics or other such gatherings. The serving platform 10 generally comprises a knock-down box which is covered by a tablecloth-like covering 20 fitted over the container. The covering 20 has pockets 22, 24 disposed along each side of the box. In the preferred embodiment, the serving platform 10 is provided as a kit which can be assembled at the site of the party or event. In addition to the knock-down box and covering, the kit would include the utensils, plates, bowls, napkins, and cups etc. The serving platform has a flat top surface 26 upon which the plates 14 and bowls, cups 15 or other tableware can be stacked. As depicted, the covering 20 includes elastic or other like means which enables the covering 20 to be placed over the box in a fitted manner. An embodiment where the covering 20 simply drapes over the sides of the container is also contemplated. As shown, the pockets can be used for holding the eating utensils 16 such as plastic knives, folks and spoons, as well as napkins 18 and other tableware. The pockets can also be divided into subpockets which operate as an organizer for retaining the knives, forks and spoons. The pockets may be sewn or likewise attached to the covering.

Figure 2:
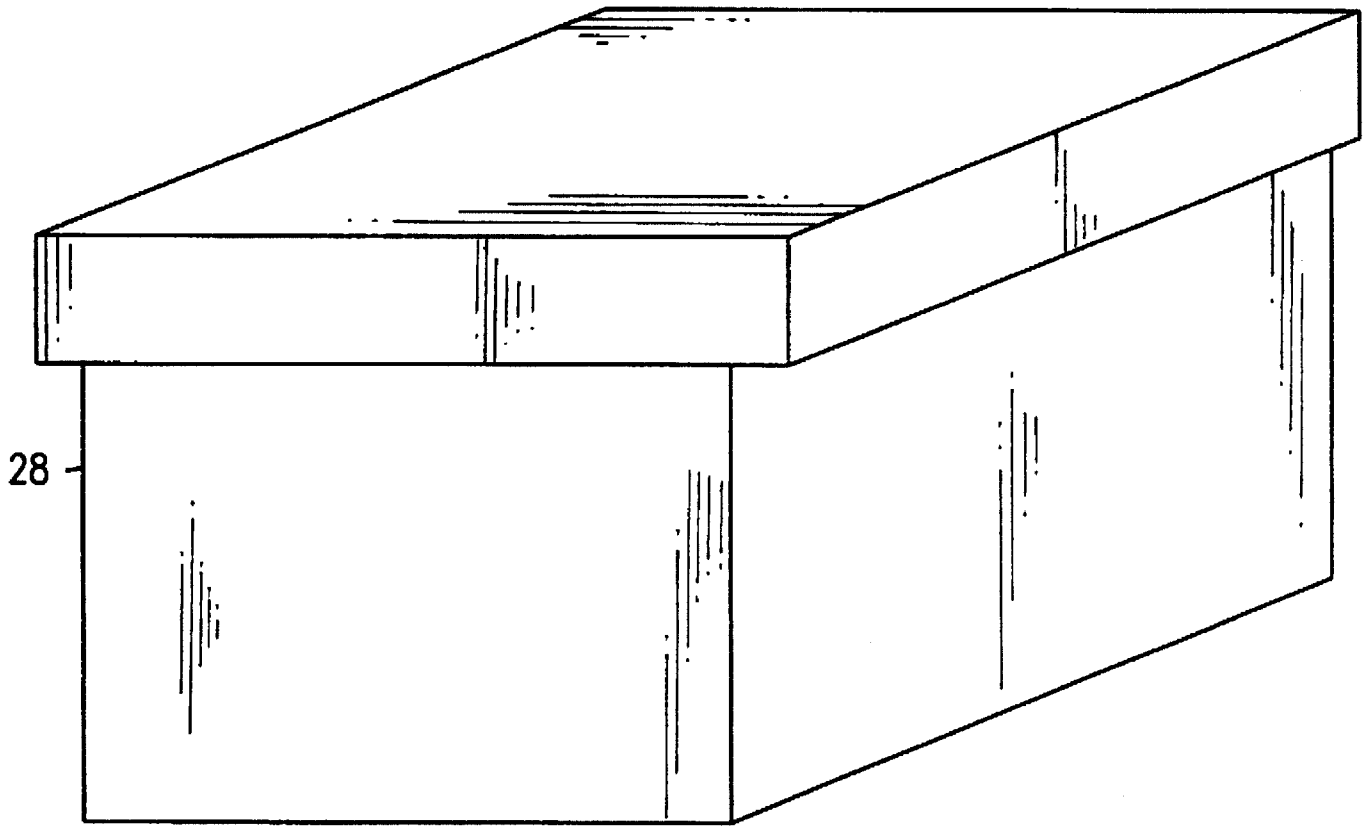
FIG. 2 is a perspective front view of the container of the preferred embodiment of present invention.

As depicted in FIG. 2, the box 28 is a rectangular knock-down box and lid, both fabricated from cardboard or like material, such containers being well known in the art. Since the lid is removable, used tableware such as plates, forks and knives or trash, etc. can be placed inside the box 28 at the conclusion of the party or affair and removed from the site. Although the box 28 is depicted as rectangular, other box shapes are possible. Alternatively, a container and removable lid both molded from plastic or any other rigid material can be used in place of the knock-down box if desired.

Figure 3:
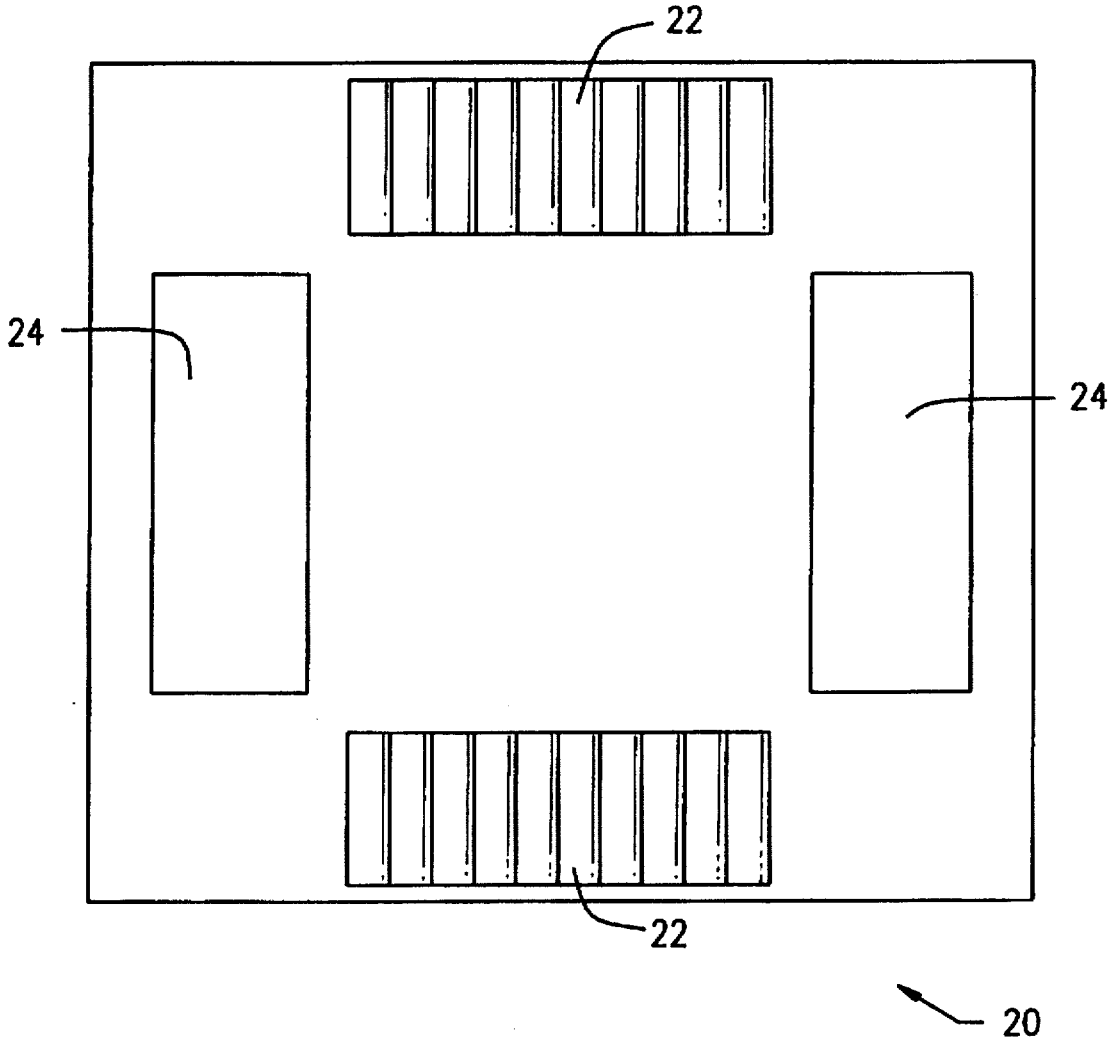
FIG. 3 is a top view of the preferred embodiment of the flexible cover of the present invention.

FIG. 3 shows the covering 20 spread out flat for illustrating the preferred embodiment in greater detail. The covering 20 shown is preferably manufactured from cloth or vinyl covered cloth material, but it is also possible to manufacture the cover 20 from any other very thin flexible plastic or material that can be folded to wrap around the box. This allows the covering to be folded and placed inside the box after the party. To enhance the party atmosphere, the covering may be decorated in a festive manner with party or other indicia. The covering shown has two pockets 24 for dispensing napkins or the like and two pleated pockets 22 which form a plurality of subpockets for dispensing utensils. As shown, the four pockets are situated on the covering so that each of the four pockets is disposed along one of the four sides of the box when the covering is placed over the box. It is contemplated that coverings may be provided having more than four or less than four pockets. In the preferred embodiment, the pockets are pieces of cloth material that are sewn onto the covering 20. As depicted, the pockets are rectangular, but other pocket configurations are possible. This embodiment is merely exemplary and modifications thereof are within the scope of the invention. For example, the pockets may be attached to the cover 20 using hook and loop fasteners. Also, separate pouches or pockets may be attached instead of dividing a pocket into subpockets.

In the present embodiment, the invention is designed for dispensing tableware for about twenty five to one hundred people. Accordingly, the assembled box has a length of about 26", a width of about 25", and a height of approximately 7". Alternatively, a larger box 28 and covering 20 designed for dispensing tableware for about one hundred to two hundred people is possible. The assembled box 28 of this embodiment has a length measuring approximately 31" and a width measuring approximately 25". These dimensions are merely exemplary, and other sized serving platforms are within the scope of the invention.

Figure 4:
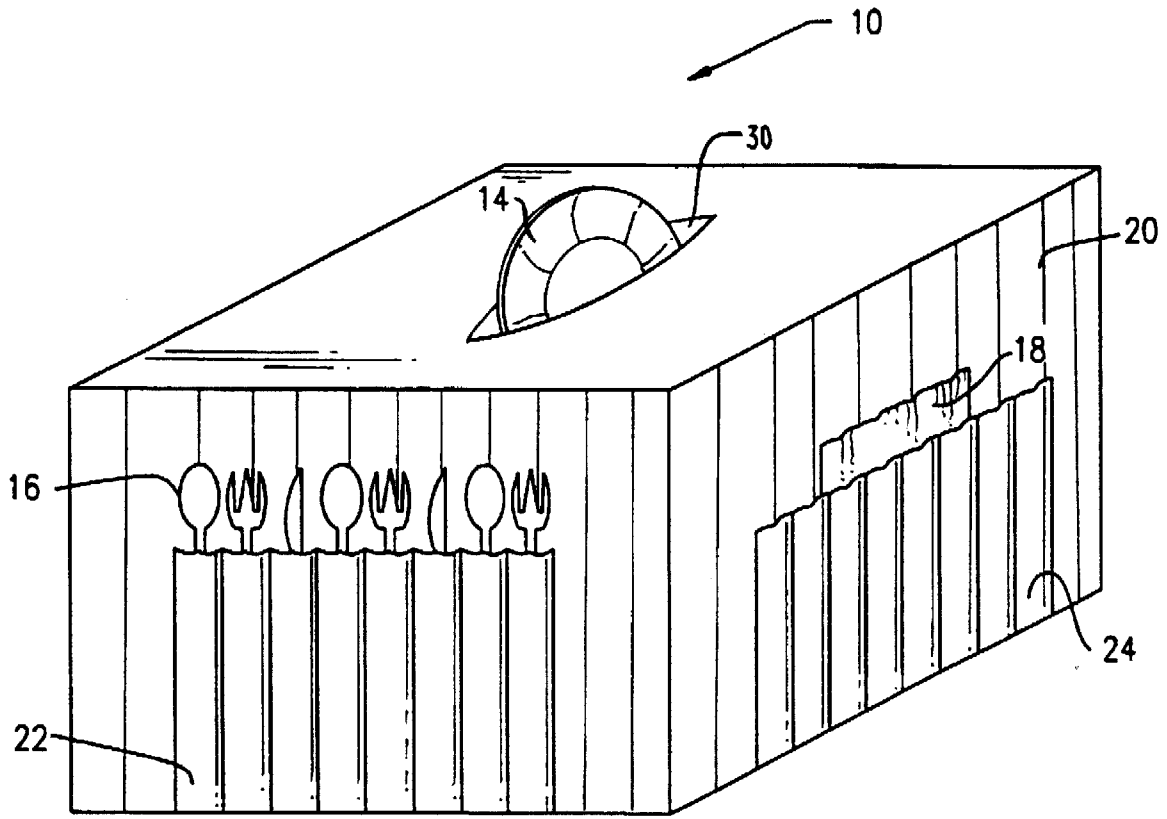
FIG. 4 is a perspective view of a second embodiment of the serving platform of the present invention.

Referring to FIG. 4, a second embodiment of the serving platform 10 of the present invention is shown. This embodiment provides a box lid and covering each having a slot or aperture 30. The aperture 30 is sized to retain plates 22 in an upright position, i.e. in a direction that is substantially perpendicular to the top surface of the serving platform 10. The covering 20 is positioned over the box so that the aperture in the covering is aligned with the aperture in the box lid. As shown, the aperture 30 is shaped as an ellipse, although it could be circular, rectangular or another configuration so long as typical plates can pass through and be retained in an upright position. It is contemplated that the slot-shaped aperture 30 is just wide enough to retain plates 22 in a generally vertical orientation as depicted in FIG. 4.

It should be understood that the embodiments described herein are merely exemplary and that a person skilled in the art may make modifications and variations to these embodiments utilizing functionally equivalent elements to those described herein. Any and all such modifications as well as others which may be apparent to those skilled in the art are intended to be included within the scope of the invention as defined by the appended claims.

I claim:

1. A serving platform for dispensing tableware and utensils to a plurality of guests comprising:

a container having a top flat face and at least one vertical side; and a cover having at least one pocket on a surface thereof for retaining the utensils, wherein the cover is adapted to be draped over the top flat face and the at least one side of the container, and wherein the at least one pocket is so disposed on the surface of the cover such that, when the cover is draped over the container, the at least one pocket is aligned with the at least one side of the container, and whereby the tableware can be displayed on the top face of the serving platform for serving a plurality of guests;

wherein said container is a knock-down box.

2. The serving platform of claim 1, wherein said cover is formed from cloth material.

3. The serving platform of claim 2 wherein said at least one pocket is sewn to said cover.

4. The serving platform of claim 1, further comprising an aperture passing through the surface of the cover and a corresponding aperture passing through the top face of the container for retaining plates in an upright position.

5. The serving platform of claim 1, wherein said container includes a removable knock-down lid.

6. The serving platform of claim 1, wherein said cover is fitted around a bottom surface of said container.

7. The serving platform of claim 1, wherein said at least one pocket comprises four pockets, each of said pockets being disposed along the at least one side of said container.

8. The serving platform of claim 1, further including tableware and utensils.

9. A serving platform assembly for dispensing tableware and utensils to a plurality of guests comprising:

a knock-down box having a top flat face and a plurality of vertical sides, the top face of the box being sized to display a plurality of tableware items;

a cloth cover adapted to be draped over the top face and sides of said knock-down box, said cover having a plurality of pockets sewn to a surface thereof, wherein each of said pockets is disposed on the cover such that the pockets will be disposed along a side of said knock down box when said cover is draped over said box, and wherein at least one of said pockets is further subdivided into subpockets, each of said subpockets being sized to retain a plurality of utensils.

10. The serving platform of claim 10 further comprising tableware for display on the top flat face of the container, wherein said tableware comprises plates, bowls, and cups.

11. The serving platform assembly of claim 10 wherein said tableware is disposable.

12. The serving platform of claim 10, further comprising utensils to be retained within the subpockets of the cover, wherein the utensils comprise knives, forks, and spoons.

13. The serving platform assembly of claim 9 wherein said plurality of pockets comprise four pockets, each of said four pockets being disposed along a side of said knock-down box.

14. The serving platform assembly of claim 9 wherein said cover is attached to a bottom surface of said box.

15. The serving platform of claim 9 further comprising an aperture for retaining plates in an upright position, said aperture extending through said cover and said box.

16. The serving platform of claim 1, wherein the container further comprises a plurality of vertical sides.

17. A serving platform for dispensing tableware and utensils to a plurality of guests, comprising:

a container having a top surface and four vertical sides extending downwardly from the top surface, wherein the top surface is sized to display tableware for service to a plurality of guests; and a cover adapted to be draped over the container, wherein the cover has a plurality of pockets sewn onto its surface, and wherein the pockets are so disposed on the cover that, when the cover is draped over the container, the pockets are aligned with the vertical sides of the container and open upwardly toward the top surface of the container, and wherein at least one of said pockets is further subdivided into subpockets, each of which is adapted to retain a plurality of utensils; and wherein at least one of said pockets is adapted to retain napkins for service to a plurality of guests.

18. The serving platform of claim 19, wherein the container further comprises a knock-down box.

19. The serving platform of claim 20, wherein the box has a length of about twenty to twenty-six inches, a width of about twenty to twenty-five inches, and a height of about five to seven inches, for serving a plurality of guests.

* * * * *